US008356801B2

(12) United States Patent
Howard et al.

(10) Patent No.: US 8,356,801 B2
(45) Date of Patent: Jan. 22, 2013

(54) PARTIALLY PRE-ASSEMBLED FENCE ASSEMBLY AND MUTLI-ELEMENT RAIL

(75) Inventors: Keith Howard, Limestone, TN (US); Joe DeSouza, Broadview Heights, OH (US)

(73) Assignee: Joe DeSouza, North Royalton, OH (US)

( * ) Notice: Subject to any disclaimer, the term of this patent is extended or adjusted under 35 U.S.C. 154(b) by 0 days.

(21) Appl. No.: 12/545,338

(22) Filed: Aug. 21, 2009

(65) Prior Publication Data

US 2011/0042637 A1 Feb. 24, 2011

(51) Int. Cl.
*E04H 17/16* (2006.01)

(52) U.S. Cl. ..... 256/21; 256/22; 256/67; 256/DIG. 2

(58) Field of Classification Search ..... 256/21, 256/22, 65.01, 67, 69, 65.03, 65.08, 65.13, 256/DIG. 2

See application file for complete search history.

(56) References Cited

U.S. PATENT DOCUMENTS

| | | | | |
|---|---|---|---|---|
| 3,258,251 | A * | 6/1966 | Culter | 256/22 |
| 3,414,236 | A * | 12/1968 | Siegal | 256/22 |
| 6,863,265 | B2 * | 3/2005 | Perry et al. | 256/22 |
| 7,384,025 | B2 * | 6/2008 | Lo | 256/65.08 |
| 7,438,284 | B2 * | 10/2008 | McGinness et al. | 256/59 |
| 7,677,535 | B1 * | 3/2010 | Lo | 256/22 |
| 2008/0029747 | A1 * | 2/2008 | Lehmann | 256/65.01 |
| 2010/0264388 | A1 * | 10/2010 | Duffy et al. | 256/22 |

* cited by examiner

*Primary Examiner* — Victor MacArthur

(57) ABSTRACT

A fence panel, a method of erecting the same, and a corresponding fence panel kit having a plurality of pickets and a plurality of multi-element rails. The rails include anchor strips that are pivotally pre-attached to the plurality of pickets, resulting in a subassembly that can be folded to an initial compact, folded configuration of the pickets and anchor strips. The subassembly can be unfolded, allowing elongate picket positioning strips to be mounted onto the pickets and the anchor strips. Locking strips are then mounted onto the anchor strips, securing the picket positioning strips in place and completing the assembly of the multi-element rail.

1 Claim, 10 Drawing Sheets

PARTIALLY PRE-ASSEMBLED FENCE ASSEMBLY AND MUTLI-ELEMENT RAIL

FIELD OF THE INVENTION

The present invention relates generally to fencing and in particular to aluminum fencing and railings, including fence/railing panels and components thereof.

BACKGROUND OF THE INVENTION

Fence panel sections are typically made up of pickets and rails. In aluminum fencing, the pickets normally are aluminum extrusions, as are the rails. Typically, the rails are screwed to the pickets to form a fence panel that is mounted between larger upright posts. Such fence panels can be assembled at a factory and then shipped as already assembled panels. However, this results in a bulkier shipment, limiting the number of fence panels that can be shipped in a container of a given size.

The fence panels can be shipped as components only and then assembled by the end user or installer. Shipping the components unassembled increases shipping density (lowering shipping costs). However, pre-assembled panels are easier for the end user or installer to work with, so there is some market resistance to purchasing fence panels from unassembled components.

SUMMARY OF THE INVENTION

Generally speaking, the present invention relates to a partially pre-assembled fence/rail panel and/or a multi-element rail for use in a fence/rail panel. In one aspect, the partially pre-assembled panel is made up of pickets and rail components that are pivotally secured to one another and collapsed into a compact form. The partially pre-assembled panel includes some component pieces that are included as part of a kit, allowing the end user to purchase the kit, erect or expand the collapsed pickets and rail components, and add the component pieces to construct a finished panel assembly. This allows the kit to be very compact for shipment and storage, and allows the end user to easily complete the assembly of the fence panel.

In one preferred form, the fence panel kit optionally comprises a plurality of pickets and a plurality of multi-element rails. The rails can include first elongate elements comprising elongate anchor strips which are pivotally attached to the pickets to allow pivotal motion between a compact, folded configuration for shipping and storage and an extended configuration in which the plurality of anchor strips are substantially perpendicular to the pickets. The multi-element rails can each further comprise a second elongate element spanning the pickets and having portions adapted to be slipped between the pickets to position the pickets and having portions to engage the anchor strip. The multi-element rails can each further comprise a third elongate element comprising an elongate locking strip adapted and configured to be mounted to the anchor strip to conceal the anchor strip and to lock the second element to the anchor strip. The kit can be provided in a partially assembled state with the pickets pivotally secured to the anchor strips of the rails in the compact, folded configuration. The second elements and the locking strips of the rails can be included as uninstalled components, ready for assembly by the end user.

In another preferred form, the present invention relates to a multi-element metal rail for use with metal pickets to form a metal fence panel. The multi-element rail optionally comprises an extruded, elongate anchor strip adapted to be pivotally attached to the pickets to allow pivotal motion between a compact, folded configuration for shipping and storage and an extended configuration in which the anchor strip is substantially perpendicular to the pickets. The multi-element rail can further comprise an extruded, elongate picket-positioning strip having a first face that extends across the pickets and a second face that has openings formed therein for receiving the pickets therethrough. The picket-positioning strip can be adapted and configured to engage the anchor strip and to be at least partially supported by the anchor strip. The multi-element rail can further comprise an extruded, elongate locking strip adapted and configured to be mounted to the anchor strip to conceal the anchor strip and to lock the picket-positioning strip to the anchor strip.

DETAILED DESCRIPTION

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Moreover, it will be recognized by those skilled in the art that the invention has ready application to both fencing and railings (such as deck railings) and the like. For convenience and conciseness, it is intended that the terms "fence" or "fence panels" as used in the claims and specification refers to both fences and railings (and panel portions of fences and railings).

Figure 1:
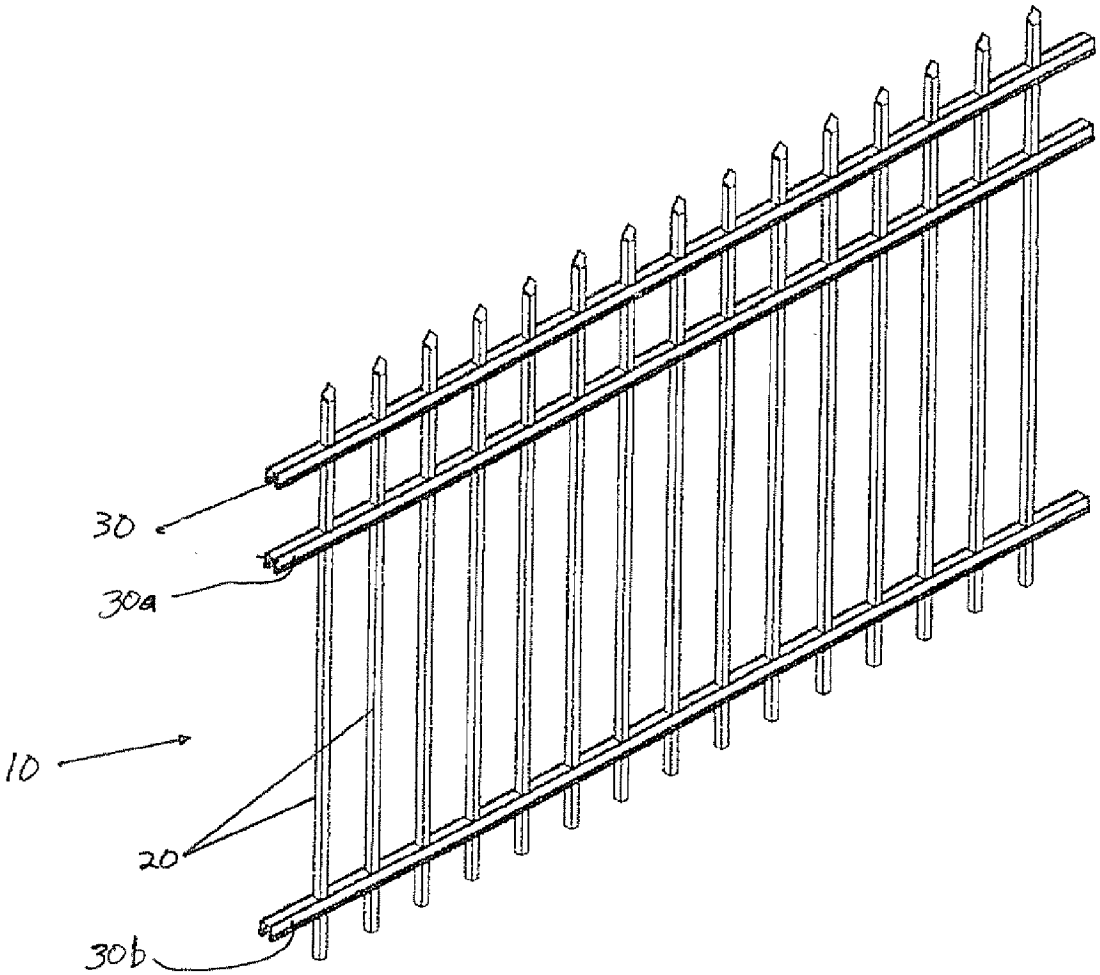
FIG. 1 is a schematic perspective illustration of an assembled fence/railing panel according to a first preferred form of the invention.
Figure 3:
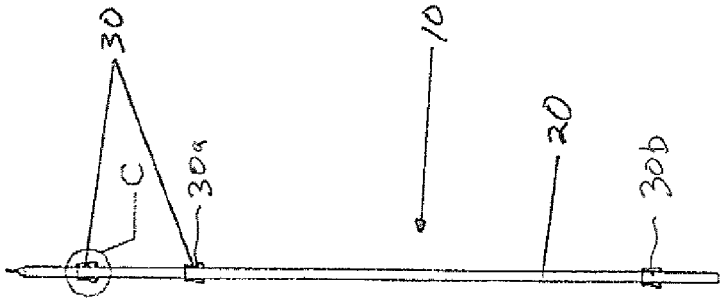
FIG. 3 is a side sectional view of the fence/railing panel of FIG. 2, taken along view lines 3-3.
Figure 2:
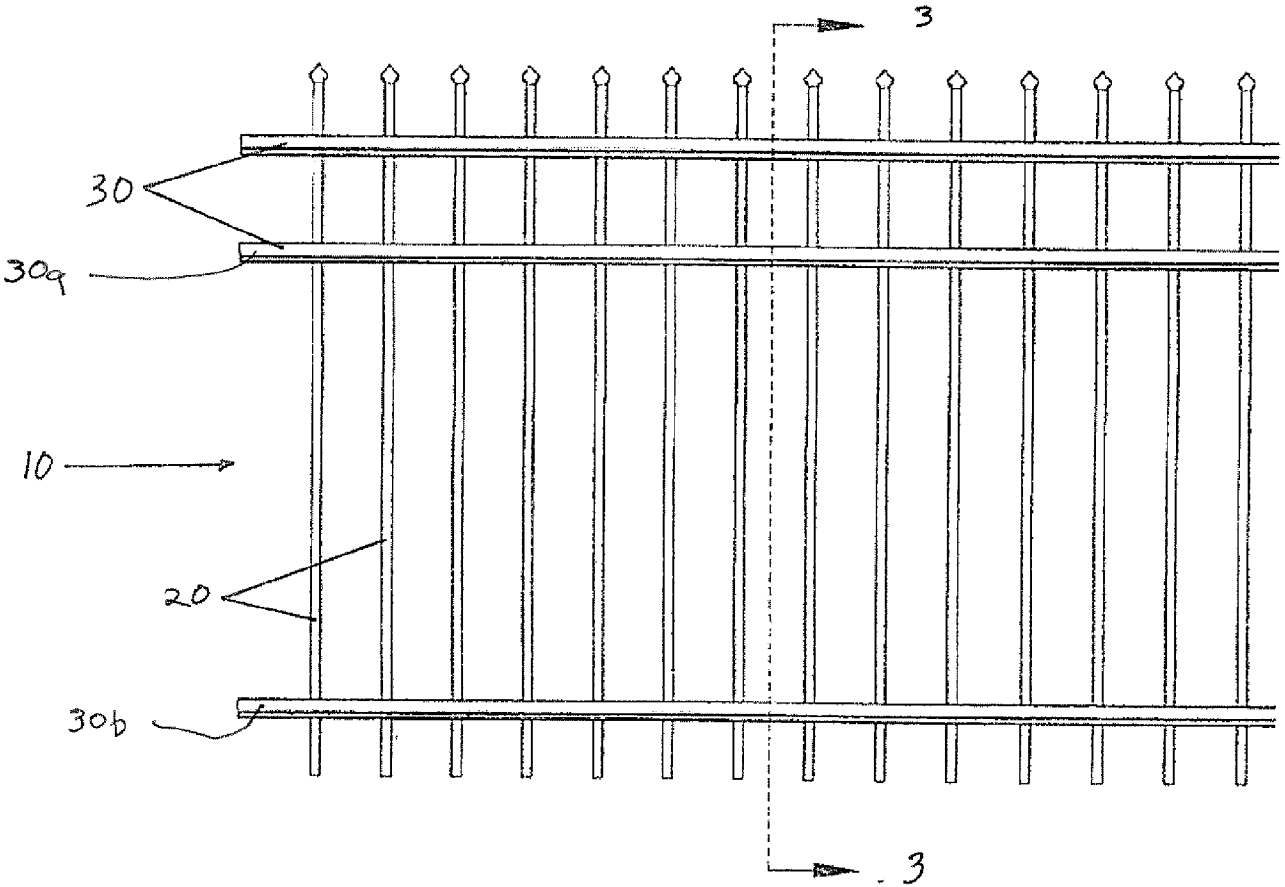
FIG. 2 is a front elevation view of the fence/railing panel of FIG. 1.

Referring now to the drawing figures, wherein like reference numerals represent like parts throughout the several views, FIGS. 1-3 show a fence/railing panel 10 comprising a plurality of upright pickets 20 and a plurality of transverse multi-element rails 30, 30*a*, and 30*b*. In this example embodiment shown, the rails 30, 30*a*, and 30*b* are identical to one another, although a fence panel can be constructed to have non-identical rails. Since the rails are identical to one another in this example embodiment, the details of the rails will be described and shown in connection with a single rail (rail 30). Also, in this example embodiment there are fifteen pickets 20 and three multi-element rails, but those skilled in the art will readily appreciate that more or fewer pickets and rails can be employed, as desired. The pickets 20 are typically parallel to each other and perpendicular to the multi-element rails 30 (when the panel if fully erected, as depicted in these first few figures), which results in the fence/railing panel 10 having a generally planar and rectangular shape. The pickets and multi-element rails can be of various types of layout and spacing schemes, depending on the aesthetic or structural design of the fence/railing panel 10. Moreover, the pickets and multi-element rails can have various external profiles, as desired to achieve a desired appearance.

Figure 4:
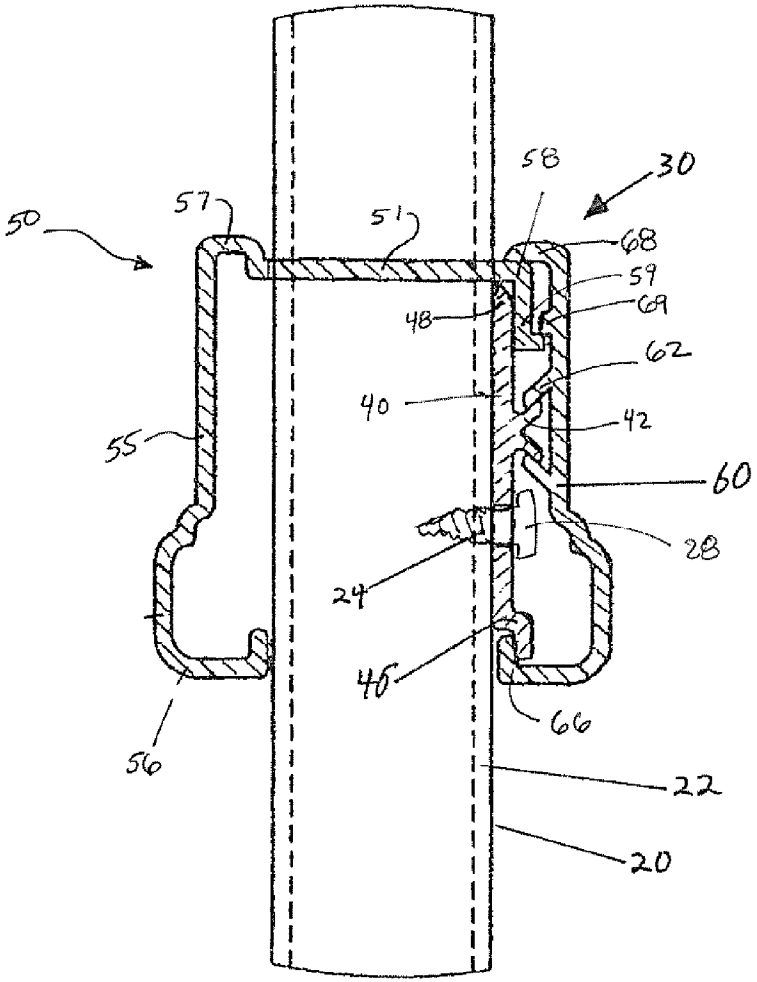
FIG. 4 is a sectional view of a portion of the fence/railing panel of FIG. 1.

As seen in FIG. 4, each picket 20 preferably comprises a picket body 22 and a fastener aperture 24. The picket body 22 generally has a uniform, symmetrical cross-section as viewed along its longitudinal axis (its axis of elongation). In this example embodiment, the picket body 22 is hollow and has a square shape cross-section and a swaged, tapered top end for an aesthetic look and to seal the top against weather. A fastener aperture 24 is located along the front face of the picket body. The aperture 24 is typically a hole that is sized according to the type and size of a fastener to be used in the fence/railing panel. Preferably, the fastener has a threaded end and a smooth shank between the head and the threads, with the smooth shank providing a pivot point for the rail to pivot about in relation to the picket. In this example embodiment, there are a total of three fastener apertures 24 per picket 20 located on the front face of each picket. The location of the apertures 24 determines the installation height of the multi-element rails.

The preferred manufacturing process to produce the components of the multi-element rail 30 is metal extrusion (and the preferred material is aluminum or alloys of aluminum). Therefore, the components of the multi-element rail 30 are generally elongated, and their cross-sections are generally uniform throughout their longitudinal axes, unless otherwise noted. The multi-element rails can be manufactured from different materials, including, but not limited to, aluminum (including alloys thereof), steel, stainless steel, brass, etc.

As can be seen in FIG. 4, the multi-element rail 30 preferably comprises an anchor strip 40, a picket-positioning strip 50, and a locking strip (or lock strip) 60. The anchor strip 40 is typically positioned on the front face of the pickets 20, spanning and extending perpendicularly to the pickets' longitudinal axes (direction of elongation). The positioning strip 50 is typically placed on the rear face of the picket 20, also spanning perpendicularly to the pickets' longitudinal axes. The lock strip 60 is mounted on the anchor strip 40, hiding the fasteners 28 from external view and keeping the positioning strip 50 in place and secured to the anchor strip 40. The components of the multi-element rail 30 are further described in the paragraphs below.

Figure 5C:
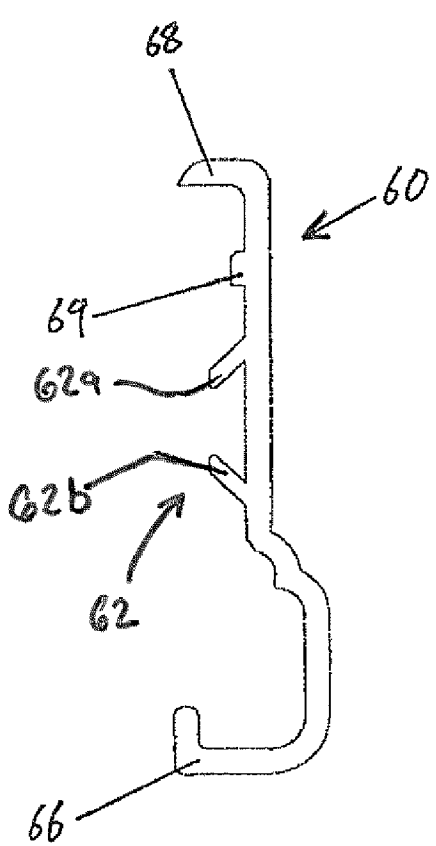
FIGS. 5A, 5B, and 5C are sectional views of portions of the fence/railing panel of FIG. 1, in particular showing component parts of a multi-element rail portion thereof.
Figure 5B:
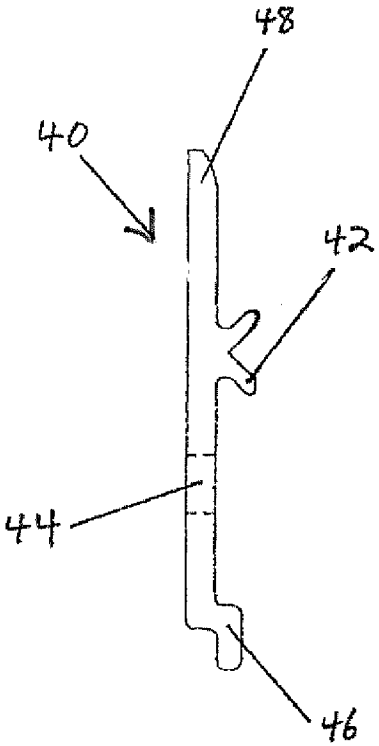

FIGS. 4 and 5B shows the anchor strip 40 in cross-section. The anchor strip 40 comprises a sliding joint element 42, a plurality of evenly spaced apart fastener apertures 44, a lower portion 46, and an upper portion 48. The sliding joint element 42 as shown is in the form of a male portion of a sliding dovetail joint (the "tail" portion of the joint) and is located slightly above the vertical middle of the anchor strip 40. As depicted, the dovetail is split with a V-shaped recess, but it could be non-split (solid) and still accomplish the same functions of positioning and securing.

The dovetail 42 cooperates with a correspondingly shaped (mating) portion 62 formed in the lock strip 60 (see FIG. 5C). In this embodiment, the fastener apertures (screw holes) 44 are equally spaced along the longitudinal axis of the anchor strip 40, located slightly below the dovetail joint. Preferably, the screw holes 44 are sized and configured to accommodate smooth rotation of the rails relative to the fasteners 28, so that the anchor strip 40 can be pivotally mounted/attached to the pickets 20. Various types of fastener can be used, including, but not limited to, bolts, screws, rivets, or any other type of pivotal attachments.

In this example embodiment, the lower portion 46 of the anchor strip 40 preferably comprises a short cantilever beam or foot projecting downwardly and that is outwardly offset from the front face of the anchor strip 40. The distal upper portion 48 of the anchor strip 40 is tapered or beveled to assist in easing the picket positioning strip thereover.

Figure 5A:
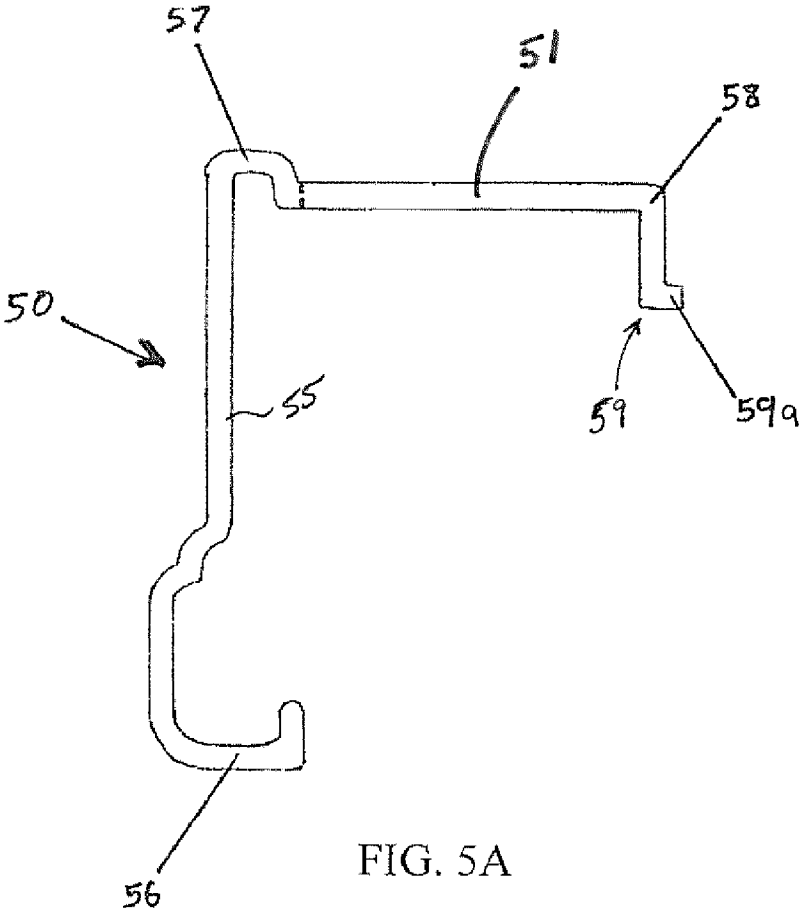

Turning now to FIGS. 4 and 5A, the picket-positioning strip 50 is seen to preferably comprise a rear vertical portion 55, a hook-shaped lower resting portion 56, and a shoulder or protrusion 57. Also, the picket-positioning strip 50 includes an upper portion 51, a front corner portion 58, and an L-shaped or hook-shaped front control portion 59 with a ridge or nub 59*a*. Overall, the picket-positioning strip 50 depicted in this example embodiment has a generally L-shaped cross-section or profile. The upper portion 51 has picket openings or notches formed therein along its length for receiving and retaining the pickets. The picket openings or notches can be seen in FIGS. 7-9 and are equally spaced laterally along the length of the positioning strip 50.

Figure 7:
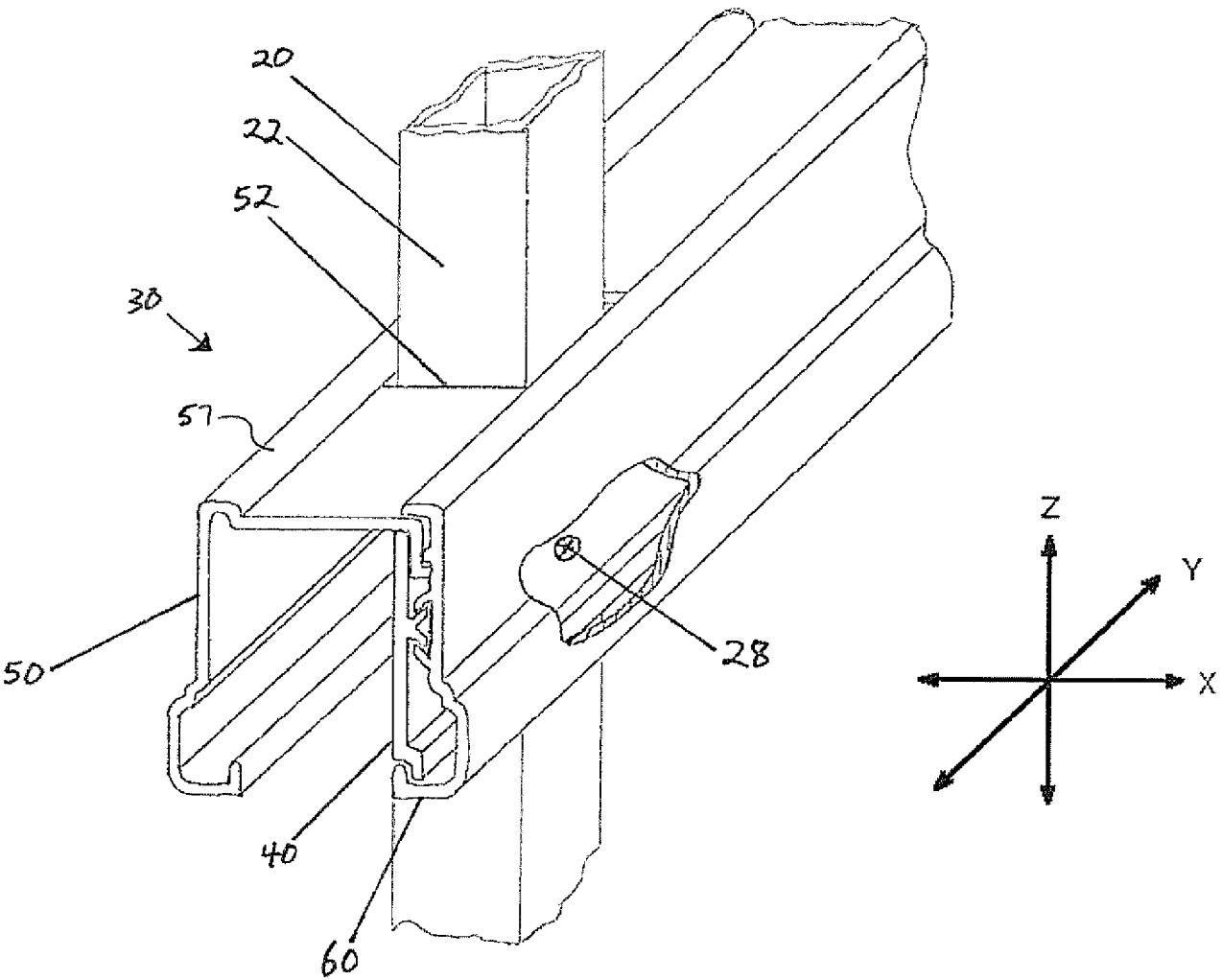
FIG. 7 is a perspective, partially cut-away view of a portion of the fence/railing panel of FIG. 1.
Figure 8:
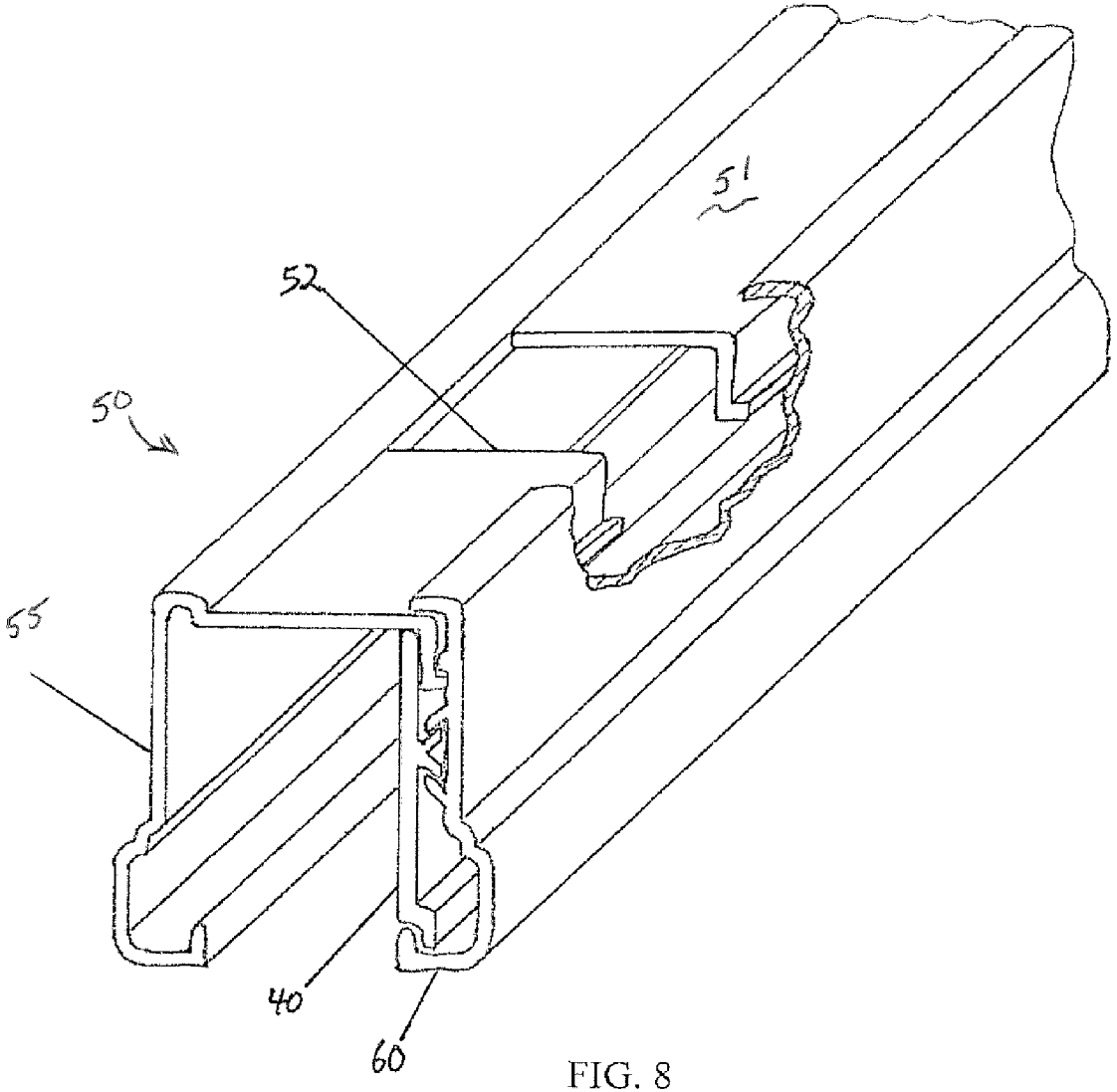
FIG. 8 is a perspective, partially cut-away view of a portion of the fence/railing panel of FIG. 1 (with a picket portion omitted for clarity of illustration).

As best seen in FIGS. 7 and 8, in this example embodiment the notches 52 are wide enough to receive a picket 20 therein and extend from adjacent the shoulder 57 to a distal end (adjacent the control portion 59). The notches 52 are shaped and dimensioned so that the pickets 20 can be held snugly within the picket-positioning strip 50. The resting portion 56 abuts against the rear face of the picket 20. The resting portion 56 has a slightly bulbous hook-shaped profile that provides lateral strength, vertical strength, and an attractive aesthetic appearance (profile). The shoulder 57 provides a pleasing aesthetic look and serves to provide lateral and vertical strength. The upper portion 58 and control portion 59 serve to connect the positioning strip 50 to the anchor strip 40, and also to the lock strip 60, which is detailed later in this description. In addition, the upper corner portion 58, together with the resting portion 56 and the anchor strip 40 and the lock strip 60, help to prevent rotation of the picket positioning strip 50 about its longitudinal axis. Thus, as will be seen in more detail below, the anchor strip 40 is screwed to the pickets and is thereby prevented from rotating about its longitudinal axis, the lock strip 60 is held fast to the anchor strip by the sliding dovetail joint and therefore is held fast against such rotation, and the picket positioning strip 50 is held in place by the anchor strip 40 and the lock strip 60. Thus, these parts are interlocking.

Referring now to FIGS. 4 and 5C, the lock strip 60 is fairly slender with an overall hook shape and is adapted and configured to create a matching, symmetrical appearance in conjunction with the picket positioning strip. In this regard, these two strips, when viewed from the front and the back of the fence panel, look rather similar to one another such that upon first glance the multi-element rail appears to be a single element with a symmetrical profile.

Furthermore, the lock strip 60 includes a sliding joint element 62, a lower hook 66, an upper hook 68, and a control ridge 69. In this embodiment, the sliding joint element 62 comprises a female portion of a sliding dovetail joint. The sliding joint 62 has a complementary shape to that of the sliding joint element 42 of the anchor strip 40.

The lower hook portion 66 preferably is the same shape (profile) as the resting portion 56 of the positioning strip 50, but mirrored in vertical orientation in order to provide vertical symmetry for the multi-element rail. The upper hook 68 is a protrusion with a tapered top face extending from the top of the locking strip towards the rear (toward the picket). The control ridge 69 is a short nub that protrudes from the lock strip 60, just above the sliding joint 62, and extends lengthwise along the lock strip.

With reference now to FIGS. 6A-8, the assembly of the fence/railing panel is explained below. As mentioned above, in one aspect the fence railing advantageously can be provided as a partially assembled kit, with some parts already assembled and some parts left unassembled (ready to be installed/assembled). Such a partially assembled kit is particularly good for maximizing shipping density (the amount of product that can be packed in a given size shipping container), is good for minimizing shelf space in retail stores, and is easily erected and completed by the end user.

Figure 6A:
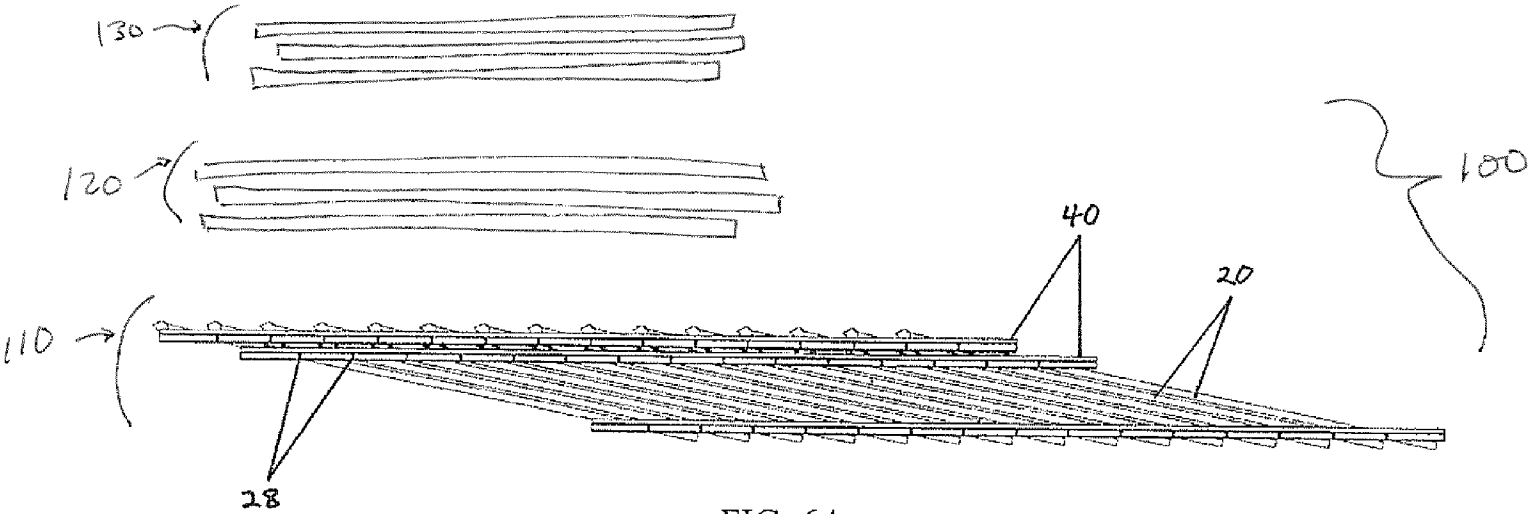
FIG. 6A is a front elevation view of a portion of the fence/railing panel of FIG. 1, shown in a compact, folded configuration for shipping and storage.

As seen in FIG. 6A, the fence/railing panel kit 100 initially includes a pre-assembled panel subassembly 110 including a plurality of pickets 20, a plurality of anchor strips 40, and a plurality of pivotal fasteners 28, shown in a generally compact, folded configuration. The kit 100 further includes a plurality (here three) picket positioning strips 120 and a plurality (again, three) lock strips 130. This kit is rather compact, but can be unfolded and assembled quickly and easily without requiring special tools or special knowledge.

Figure 6B:
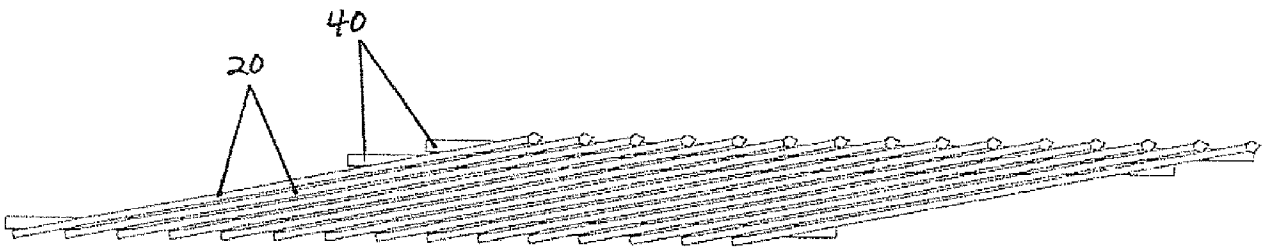
FIG. 6B is a rear elevation view of a portion of the fence/railing panel of FIG. 1, shown in a compact, folded configuration for shipping and storage.

FIG. 6A shows a front view of the pickets 20 pivotally attached to the anchor strips 40 by the fasteners 28. Note that the anchor strips 40 align the pickets 20 to be parallel to one another, even in the folded configuration. The kit's panel subassembly 110 shown in FIG. 6B is shown with the rear face view of the folded configuration shown in FIG. 6A. Note that fasteners are not located on the rear face of the pickets 20 (although rear fasteners can be employed, as needed).

FIG. 7 shows a portion of an assembled fence panel according to an example embodiment of the present invention, in particular showing a multi-element rail 30 with a picket 20 extending therethrough. In this view, a middle portion of the lock strip 60 is cut away to reveal the fastener 28 used to secure the anchor strip 40 to the picket 20. To assemble such a multi-element rail 30, the panel in its initially-folded configuration shown in FIGS. 6A and 6B is first extended or unfolded, resulting in the anchor strips 40 being perpendicular to the pickets 20 and the panel having a generally rectangular shape. The positioning strips 50 are then slipped over the anchor strips 40 and between the pickets so that the picket notches 52 are aligned with the pickets 20 in the Y direction. As seen before in FIG. 8, the notches 52 are formed in the positioning strip 50, extending from the control portion 59 to adjacent the shoulder 57 of the positioning strip 50. The picket positioning strip 50 is slipped between the pickets 20 by moving the positioning strip in the X direction. The upper portion 58 of the positioning strip 50 is then placed over the upper portion 48 of the anchor strip 40 by lowering the positioning strip 50 in the Z direction. With the picket positioning strip 50 thus hung on the top of the anchor strip 40 and straddling the pickets, the resting portion 56 of the positioning strip 50 rests against the rear face of the pickets 20. The lock strip 60 is then slid laterally along in the Y direction and onto the anchor strip 40 by aligning one end of the lock strip 60 against an opposite end of the anchor strip 40, and sliding the lock strip 60 onto the anchor strip 40. Once the lock strip is slid over the anchor strip using the sliding joint, the various elements of the multi-element rail 30 are locked together.

FIG. 8 shows a portion of an assembled fence panel according to an example embodiment of the present invention, in particular showing a multi-element rail 30 but without a picket extending therethrough. Instead, in this view, an upper portion of the lock strip 60 is cut away to depict the notch 52 formed in the top 51 of the positioning strip 50.

The resulting multi-element rail 30 has several interlock surfaces or features that help to secure the three extrusions to one another. In this way, the three components of the multi-element rail 30 help to hold the multi-element rail together and maintain a substantially rigid U-shaped structure. The first such interlocking feature is the engagement of the lock strip sliding joint element 62 with the anchor strip sliding joint element 42. In this example embodiment, the female portion of the dovetail joint on the lock strip 60 slides over the male portion of the dovetail joint on the anchor strip 40, holding these two strips together. The second interlocking feature is the engagement of the lower hook 66 of the lock strip 60 hooking under the lower portion 46 of the anchor strip 40. The third interlocking feature is the engagement of the upper hook 68 of the lock strip 60 hooking over the upper portion 58 of the positioning strip 50. The upper portion 58 of the positioning strip 50 is held fast between the upper portion 48 of the anchor strip and the upper hook 68 of the locking strip. A fourth interlocking feature is the engagement of the control portion 69 of the lock strip 60 and the control portion 59 of the positioning strip 50. In this embodiment, the protrusion on the control portion 69 engages the top of the nub/ridge 59*a* on the control surface 59.

The interlocking features serve to hold the multi-element rail together as a rigid or substantially-rigid structure, as well as to prevent rotation of the three components about the axis of elongation. The control portions 59 and 69 cooperate with each other to limit rotation of the positioning strip about its axis of elongation. The resting portion 56 of the positioning strip 50 and the other interlocking interactions between the components of the multi-element rail help to prevent rotation of the positioning strip 50 and the lock strip 60.

Figure 9:
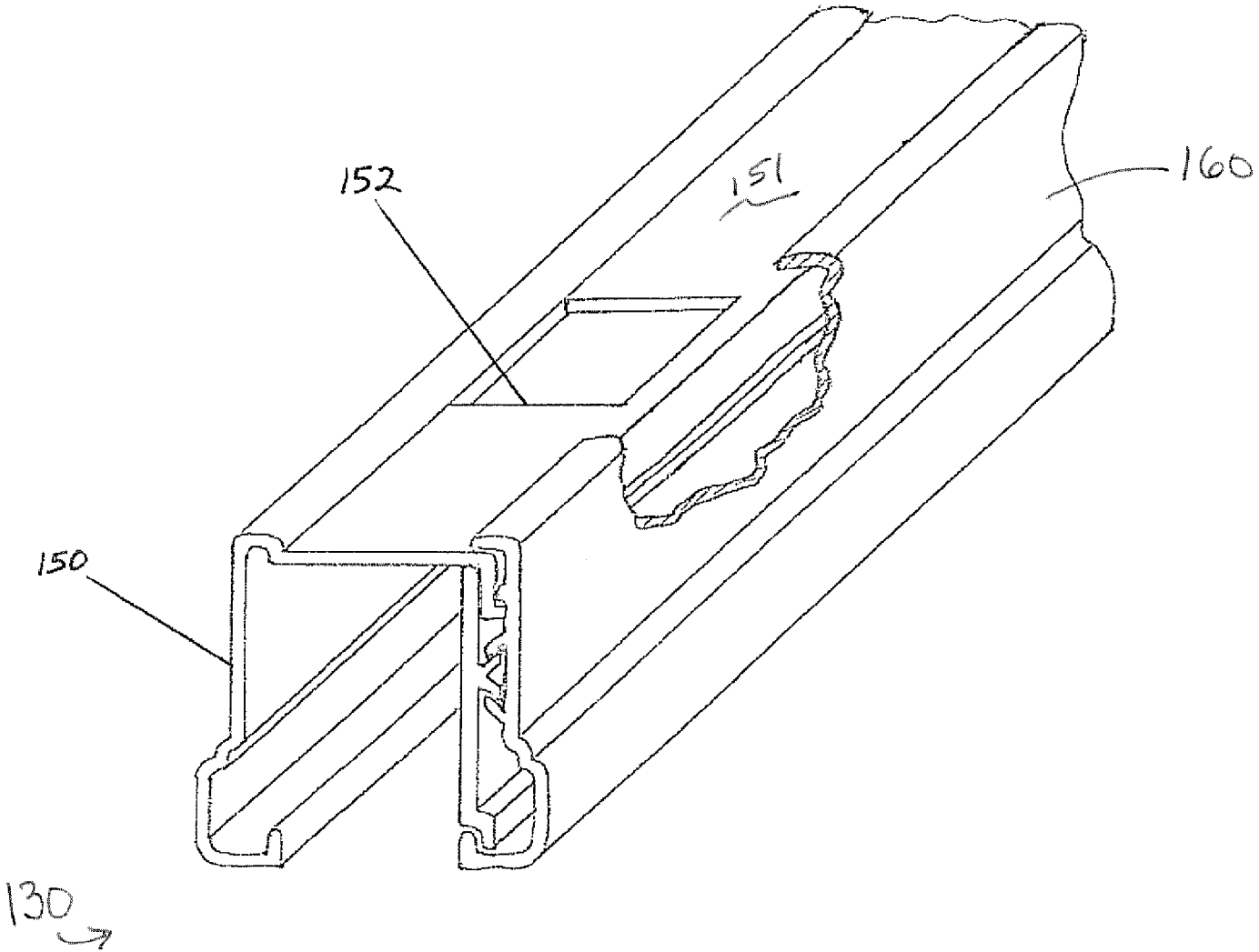
FIG. 9 is a perspective, partially cut-away view of a multi-element rail portion of a fence/railing panel according to an alternate form of the invention (with a picket omitted for clarity of illustration).

With reference now to another example embodiment of the present invention, FIG. 9 shows a portion of an assembled fence panel according to an example embodiment of the present invention, in particular showing a multi-element rail 130 but without a picket extending therethrough. In this figure, an upper portion of the lock strip 160 is cut away to reveal a square picket opening 152 bounded on four sides (as compared to the notch 52 shown in FIG. 8). As shown in this figure, a picket-positioning strip 150 features apertures 152 formed in the top face 151 of the positioning strip, which are present for receiving the pickets (unshown in this figure) therethrough. However, this arrangement is less conducive to collapsing the pickets and rail components for shipping and storage, inasmuch as the opening 152 being bounded on all four sides means that the picket positioning strip 150 has to be slipped over the ends of the pickets and slid lengthwise along the pickets to final position, instead of allowing the picket positioning strip to be slipped between the pickets from the rear. Moreover, with the picket positioning strips 152 slipped over the pickets, the pickets than are more constrained against collapsing to a compact configuration. Thus, this arrangement is less useful for collapsing the pickets to a compact configuration, but may still be desired in some circumstances.

Figure 10B:
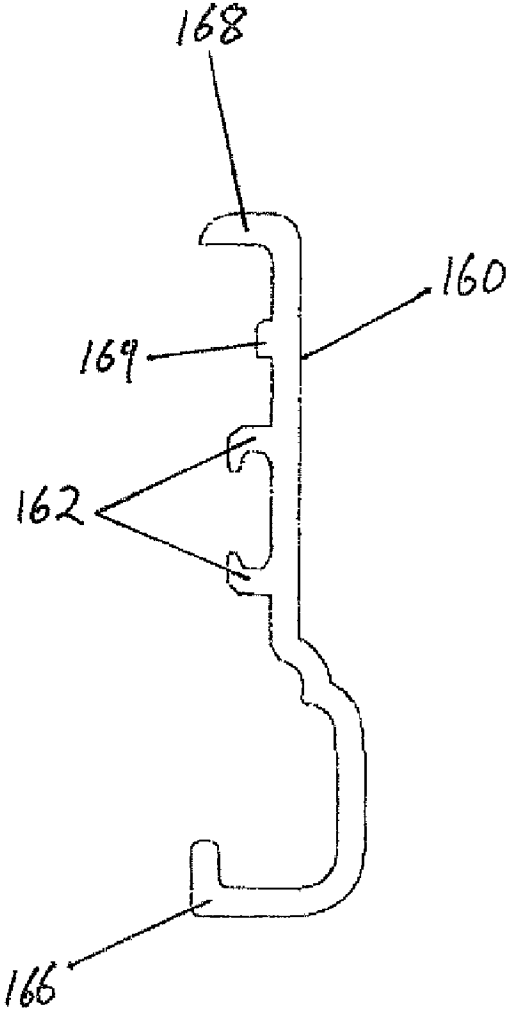
FIGS. 10A and 10B are sectional views of a multi-element rail portion of a fence/railing panel according to another alternate form of the invention.
Figure 10A:
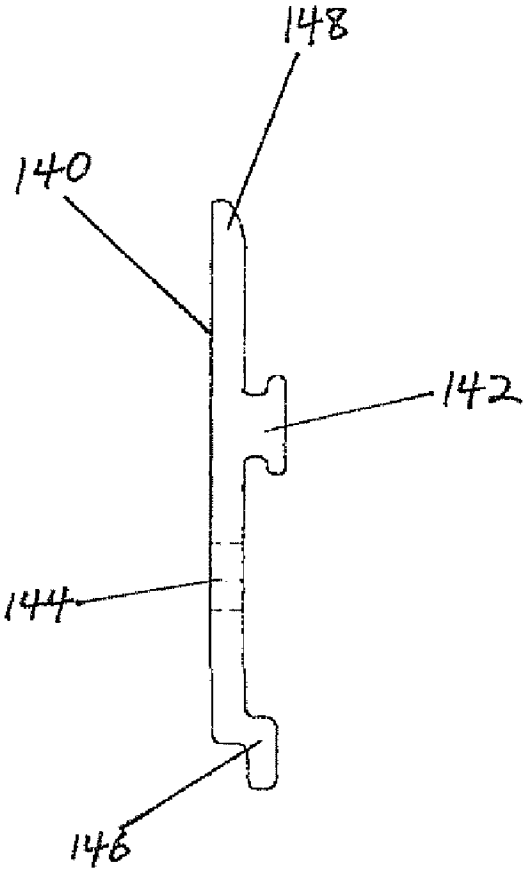

The sliding joints may take myriad forms. With reference now to example embodiments of an anchor strip 140 and a lock strip 160 shown in FIGS. 10A and 10B, it can be seen that the sliding joint can comprise complementary elements using a T-slot arrangement, with optional rounded ends. The rounded T-slot joint elements 142 and 162 provide similar interlocking action as described above. The choice of a different style or design of sliding joint can be favorable in certain situations, i.e. for certain mechanical properties, aesthetic purposes, material usage, or cost.

Figure 11B:
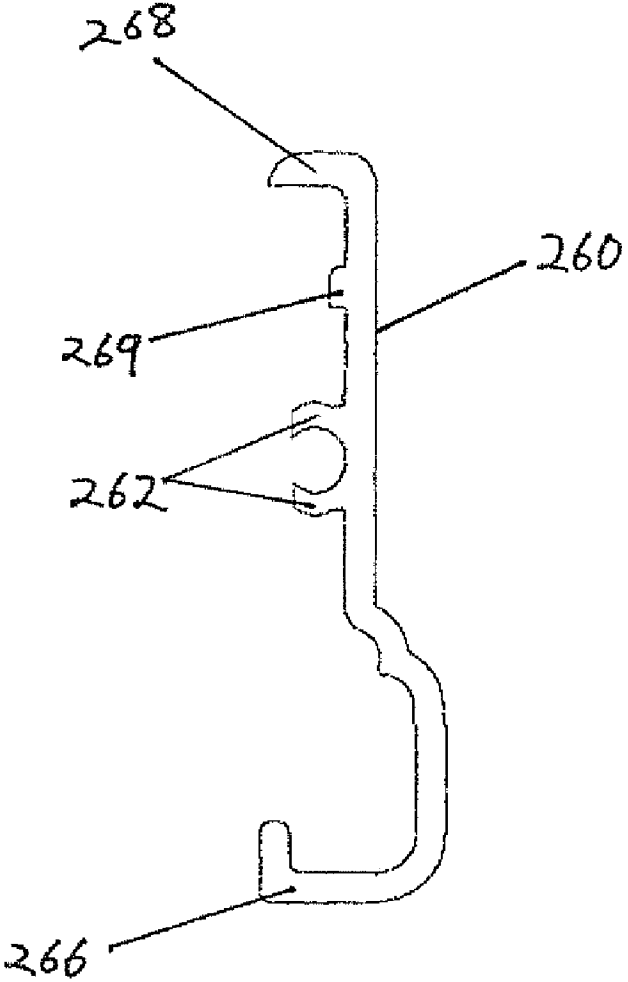
FIGS. 11A and 11B are sectional views of a multi-element rail portion of a fence/railing panel according to another alternate form of the invention.
Figure 11A:
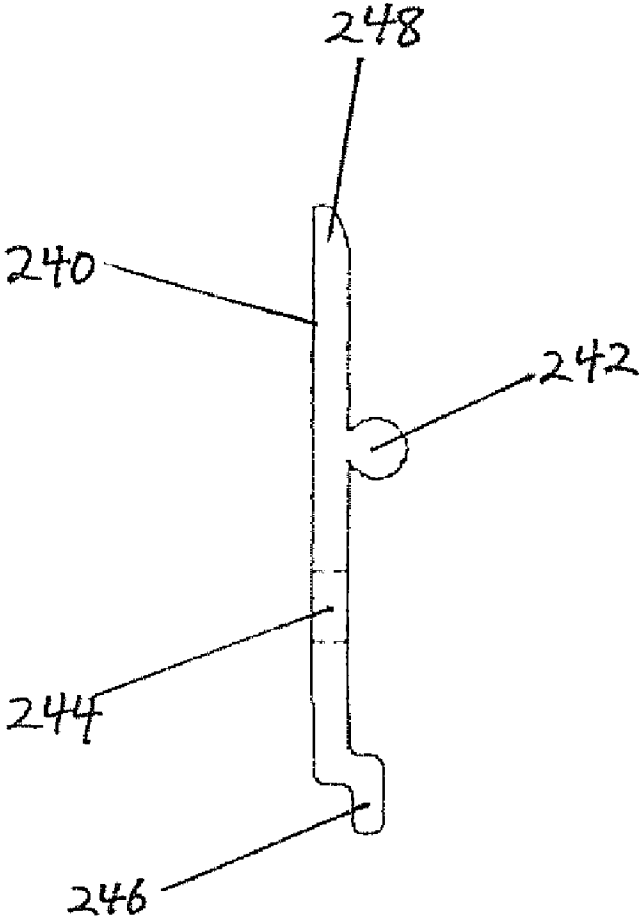

In other example embodiments, the sliding joints may be replaced with a sliding ball and socket rail joint, as depicted in FIGS. 11A and 11B. The elongate ball 242 can either slide transversely into the socket joint 262, similar to the other embodiments of the sliding joint, or the socket joint 262 can be coupled with the ball joint 242 by first engaging the lower hook 266 of the locking strip 260 underneath the lower portion 246 of the anchor strip 240 and then rotating the lock strip 260 towards the anchor strip 240 such that first the lower arm of the socket joint 262 couples with the lower half of the ball joint 242, then the upper arm of the socket joint 262 traverses over the upper half of the ball joint 242 in a counter-clockwise fashion, resulting in a full coupling between the ball joint 242 and the socket joint 262. This embodiment may be favorable for certain scenarios where coupling the locking strip 260 to the anchor strip 240 by such snap-on action is desirable over sliding them together. Other example embodiments may include other sliding or coupling joinery techniques.

While this invention has been described in detail with particular reference to exemplary embodiments and variations thereof, it is to be understood that other variations and modifications can be effected within the scope and spirit of the invention, as described above and as defined in the appended claims.

What is claimed is:

1. A fence panel kit comprising:

a plurality of pickets;

a plurality of multi-element rails, each including a first elongate element comprising an elongate anchor strip which is pivotally attached to the pickets to allow pivotal motion between a compact folded configuration for shipping and storage, and an extended configuration in which the anchor strip is substantially perpendicular to the pickets, fasteners securing the multi-element rails to the pickets in a manner that hides the fasteners from external view;

the multi-element rails each further comprising a second elongate element having a generally L-shaped strip with picket-receiving notches formed in one face thereof, the second elongated element spanning the pickets and having portions adapted to be slipped between the pickets to position the pickets and having portions to engage the anchor strip, the second elongate element being a separate element from the first elongate element and adapted to be slipped between the pickets while the anchor strip is pivotally attached to the pickets, a portion of the generally L-shaped strip hooks over and engages an upper portion of the anchor strip to at least partially secure the L-shaped strip to the anchor strip, another portion of the generally L-shaped strip rests against the pickets when installed;

the multi-element rails each further comprising a third elongate element comprising an elongate locking strip adapted and configured to be mounted to the anchor strip with a sliding dovetail joint, and mounted to the second elongate element to conceal the anchor strip and to lock the second elongate element to the anchor strip, the elongate locking strip being a separate element from the first elongate element and the second elongate element and adapted to be attached to the anchor strip while the anchor strip is pivotally attached to the pickets; and wherein the kit is provided in a partially assembled state with the pickets pivotally secured to the anchor strips of the rails in the compact, folded configuration, and wherein the second elements and the locking strips of the rails are included as uninstalled components, ready for assembly by the end user.

* * * * *